US009309682B2

(12) United States Patent
Hurst

(10) Patent No.: US 9,309,682 B2
(45) Date of Patent: Apr. 12, 2016

(54) STRONG ARM BOLT-REBAR HANGER SYSTEM FOR CONCRETE FOOTING FORMS

(71) Applicant: Ralph Gerald Hurst, Tehachapi, CA (US)

(72) Inventor: Ralph Gerald Hurst, Tehachapi, CA (US)

( * ) Notice: Subject to any disclaimer, the term of this patent is extended or adjusted under 35 U.S.C. 154(b) by 48 days.

(21) Appl. No.: 13/694,912

(22) Filed: Jan. 19, 2013

(65) Prior Publication Data

US 2014/0115996 A1 May 1, 2014

Related U.S. Application Data

(63) Continuation-in-part of application No. 12/932,173, filed on Feb. 19, 2011, now abandoned.

(51) Int. Cl.
*E04G 21/18* (2006.01)
*E04C 5/18* (2006.01)
*E04C 5/16* (2006.01)

(52) U.S. Cl.
CPC ..... *E04G 21/185* (2013.01); *E04C 5/168* (2013.01); *E04C 5/18* (2013.01)

(58) Field of Classification Search
CPC ..... E04G 21/12; E04G 21/185; F16L 3/14; E04C 5/168; E04C 5/18
USPC ..... 249/2, 3, 4, 5, 6, 7, 8, 34, 91, 93, 94, 249/96, 97; 52/699, 700, 701, 506.02, 508, 52/513, 712, 714; 211/119; D8/380
See application file for complete search history.

(56) References Cited

U.S. PATENT DOCUMENTS

| | | | | | |
|---|---|---|---|---|---|
| 467,491 | A | * | 1/1892 | Anderson | 52/489.1 |
| D31,509 | S | * | 9/1899 | Heib | D8/380 |
| 1,329,362 | A | * | 2/1920 | Bowe | 249/94 |
| 2,279,644 | A | * | 4/1942 | Spalding | 52/506.03 |
| 2,503,648 | A | * | 4/1950 | Zeigler | 211/119 |
| 3,084,892 | A | * | 4/1963 | Priestley et al. | 248/61 |
| 4,136,784 | A | * | 1/1979 | Knobel et al. | 211/119 |
| D257,947 | S | * | 1/1981 | Reynoso | D8/373 |
| 4,765,108 | A | * | 8/1988 | Lapish | 52/379 |
| 4,945,704 | A | * | 8/1990 | Brown, Jr. | 52/706 |
| 4,957,259 | A | * | 9/1990 | Wolf, Jr. | 248/304 |
| 5,042,218 | A | * | 8/1991 | Nasca et al. | 52/677 |
| 5,174,083 | A | * | 12/1992 | Mussell | 52/169.1 |
| D337,510 | S | * | 7/1993 | Nasca | D8/354 |
| 5,388,804 | A | * | 2/1995 | Cohen et al. | 249/210 |
| 5,607,124 | A | * | 3/1997 | Earley | 248/48.2 |
| 5,640,822 | A | * | 6/1997 | Haswell | 52/712 |
| 6,128,883 | A | * | 10/2000 | Hatzinikolas | 52/698 |

(Continued)

*Primary Examiner* — Michael Safavi
(74) *Attorney, Agent, or Firm* — MU Patents; Timothy Marc Shropshire

(57) ABSTRACT

An apparatus with multiple components to create a system capable of holding foundation bolts and foundation rebars prior to pouring concrete. The apparatus consists of [1] A ⅛ inch thick by one inch wide by ten inch length steel plate bent and twisted in a manner to hold both bolt and rebars. [2] A square steel tube one inch by one inch by one inch with ⅛ inch wide by ½ inch deep notch to be used in conjunction with above mentioned strong arm. [3] A ⅛ inch thick by one inch wide by seven inch length steel plate with the top portion bent over one inch with a ⅝ inch hole to accommodate a foundation bolt and two ⅝ inch notches to hold top and bottom rebar. [4] A ⅛ inch by 20 inch steel rod bent in a described manner to hang the top and bottom rebars from above described strong arm and independent of claim 2. [5] A ⅛ inch by 6 inch steel rod bent in a described manner as to hold 2 foundation rebars independent of components 1 through 4.

1 Claim, 4 Drawing Sheets

(56) References Cited

U.S. PATENT DOCUMENTS

| | | | | |
|---|---|---|---|---|
| 6,230,467 | B1 * | 5/2001 | Leek | 52/702 |
| 6,490,840 | B1 * | 12/2002 | Thompson | 52/715 |
| 6,510,666 | B1 * | 1/2003 | Thompson | 52/712 |
| 6,554,231 | B2 * | 4/2003 | Choi | 248/65 |
| 6,629,394 | B1 * | 10/2003 | Trevino | 52/677 |
| 6,811,130 | B1 * | 11/2004 | Oh | 248/343 |
| D502,516 | S * | 3/2005 | Chen | D21/694 |
| 7,959,125 | B1 * | 6/2011 | Coleman | 249/34 |
| 8,904,731 | B2 * | 12/2014 | Hohmann et al. | 52/714 |
| 8,915,384 | B2 * | 12/2014 | Immerman et al. | 211/119 |
| 2001/0030267 | A1 * | 10/2001 | Caveney et al. | 248/68.1 |
| 2006/0248843 | A1 * | 11/2006 | Zapata et al. | 52/687 |
| 2008/0116235 | A1 * | 5/2008 | Zamzow | 223/85 |
| 2010/0308182 | A1 * | 12/2010 | Lahti | 248/59 |
| 2011/0072751 | A1 * | 3/2011 | Clear et al. | 52/415 |

* cited by examiner

STRONG ARM BOLT-REBAR HANGER SYSTEM FOR CONCRETE FOOTING FORMS

CROSS REFERENCE TO RELATED APPLICATION

This application is a continuation in part of U.S. patent application Ser. No. 12/932,173 filed Feb. 19, 2011

FIELD OF THE INVENTION

The present invention relates to the construction of buildings with a typical exterior foundation known as footings. The invention creates a system for securing the foundation bolts and hangs the foundation steel bars known as rebars.

BACKGROUND OF THE INVENTION

For many years buildings used for homes or commercial use have been built in a manner that lacks structural integrity. In areas that are subject to earthquakes, tornadoes, and hurricanes, it is of utmost importance that the foundations are constructed with great strength.

In previous years foundation bolts were made of smaller diameter and shorter lengths and merely pressed down into wet concrete after it was poured. This resulted in small voids around the bolt which resulted in weaker structural strength.

It is of utmost importance that foundation bolts when placed in their required position stay without movement while the concrete is poured around them. New building codes require these bolts be placed in position prior to concrete being poured.

Building codes require that the foundation rebars be positioned in a manner that prevents them from coming in contact with earth. The current method for achieving this is to place the bottom rebar on cement blocks and hang the top rebars by tie wires to the forms or stakes above.

SUMMARY OF THE INVENTION

The object of the invention is to secure the foundation bolts in a manner to stay at an exact height and held in an exact distance from the edge of the slab. This invention system also hangs and secures as many as four foundation rebars in the required location in the footings by hanging from the metal strong arm.

DETAILED DESCRIPTION

The following detailed description represents the best currently contemplated modes for carrying out the invention. The description is not to be taken in a limiting sense, but is made merely for the purpose of illustrating the general principles of the invention, a five component bolt and reinforcing bar system.

Figure 1:
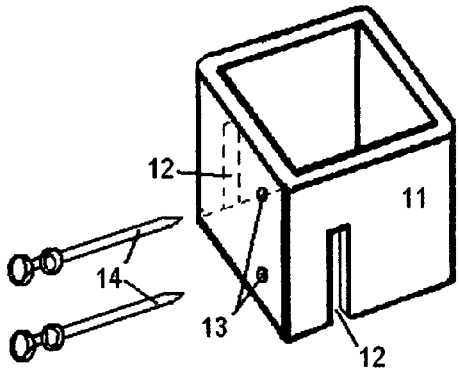
FIG. 1 is a perspective view of a square metal tube bracket in accordance with the present invention.
Figure 2:
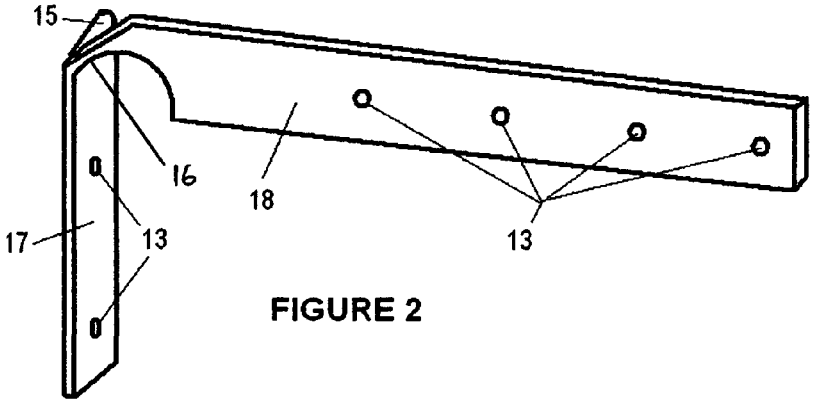
FIG. 2 is a full dimensional perspective view of a metal strong arm bracket in accordance with the present invention.

Referring to FIG. 1, a component hereafter known as component A that works in conjunction with component B [FIG. 2]. The square metal tube 11 is a one inch by one inch by one inch long tube with a ⅛ inch wall thickness. This tube has a one inch wide by ½ inch deep notch. 12 on both sides by the side wall, this leaves a ⅝ inch clearance to allow a ⅝ inch bolt to pass through. On the opposite side walls it has two ⅛ inch holes 13 at the top and bottom to receive two keeper pins 14. The ⅛ inch notches 12 of the metal tube 11 slips over the horizontal bar of the metal strong arm 18. The bottom pin hole 13 is aligned with the pin hole 13 in the metal strong arm 18 to lock it in place with the keeper pin 14. The foundation bolt 25 is then placed up through the tube 11 [see FIG. 9].

Referring to FIG. 2, known as component B. This is a ⅛ inch thick by one inch wide by 11 inch long flat metal plate with a 4 inch vertical portion 17 then bent at 90 degree 15 with a full twist 16 to create the horizontal portion of the strong arm This seven inch long arm has four ⅛ inch pin holes 13. The vertical portion 17 is designed to nail to the side of a wooden form board [see FIG. 10]. This component is designed to work independently of the metal tube 11 to support the third component known as component C, a ⅛ inch steel rod shaped to support two reinforcing bars 32 [see FIGS. 3 & 10].

Figure 3:
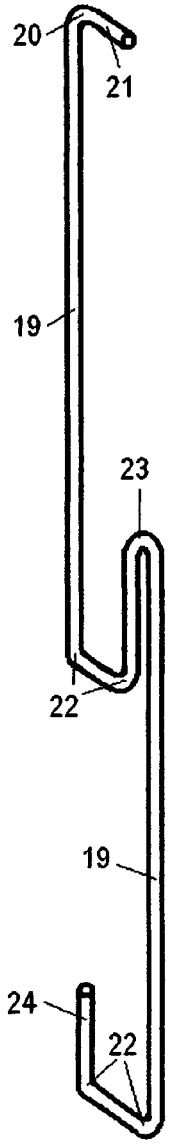
FIG. 3 is a perspective view of a rod shaped rebar holder of the present invention.

Referring to FIG. 3, component C, a ⅛ inch by 21 inch steel rod shaped as follows, a ½ inch long horizontal portion 21 then bent 95 degrees downward 20 to create a vertical member 19 eleven inches long, bent again at 90 degrees 22 to create a ⅝ inch wide horizontal portion, then bent upwards 90 degrees 22 for one inch vertical, then bent downward 180 degrees 23 to a vertical portion six inches long 19 then again bent 90 degrees 22 for a ⅝ inch horizontal portion then 90 degrees upward 22 for a one inch vertical arm 24. This component is designed to accommodate holding a top and bottom reinforcing bar 32 [see FIG. 10], and to hang from strong arm 18 by slipping horizontal portion 21 through pin holes 13 [FIG. 2].

Figure 4:
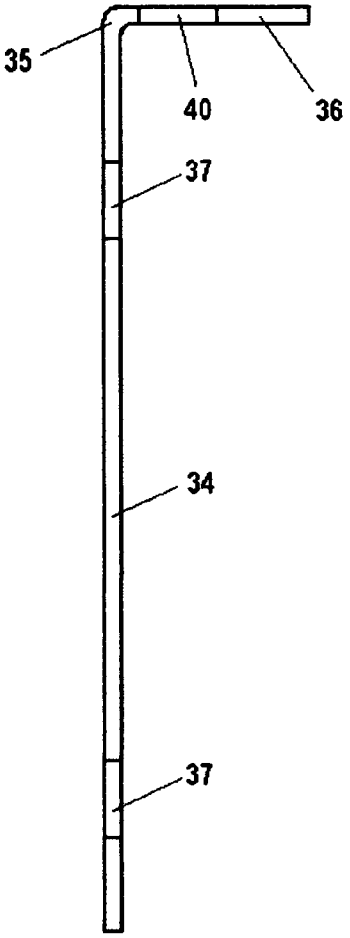
FIG. 4 is a side view of a metal plate rebar holder of the present invention.
Figure 5:
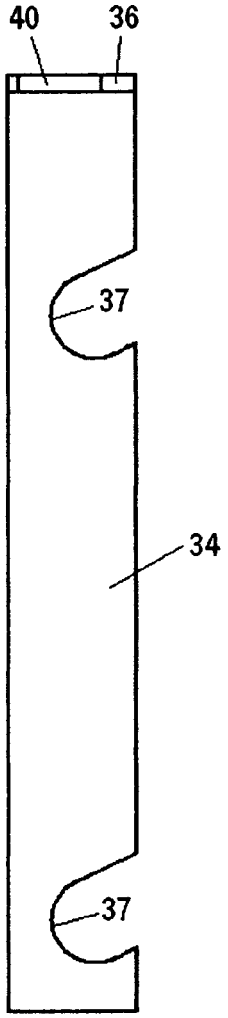
FIG. 5 is a front view of a metal plate rebar holder of the present invention.

Referring to FIGS. 4 & 5, describes a side elevation and a front elevation of the fourth component of the strong arm bolt and rebar system, Component D. This component is a ⅛ inch thick by one inch wide by seven inch long flat metal plate. Looking at the side elevation, [FIG. 4] a horizontal length one inch 36 with a ⅝ inch hole 40 bent at 90 degrees downward 35 to create a six inch vertical member 34. This vertical member 34 has a ⅝ inch wide elongated downward notch 37 at the top and bottom portion to hold a top and bottom reinforcing bars 32 [see FIGS. 6 & 10].

Figure 6:
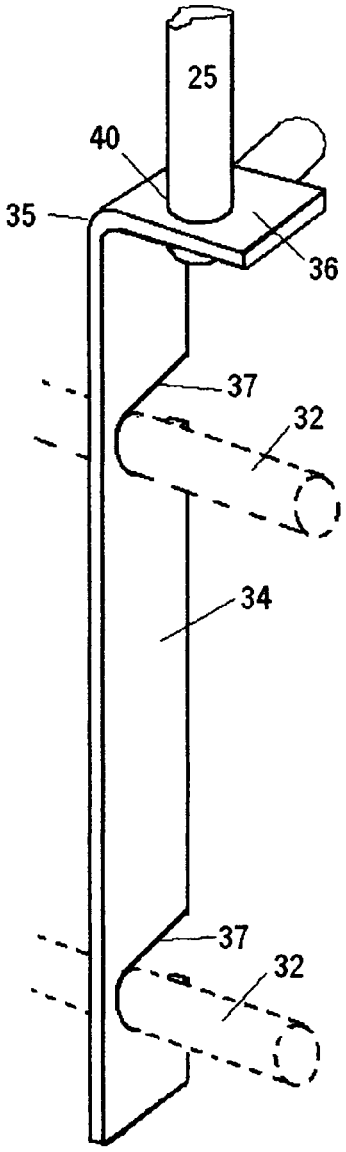
FIG. 6 is a perspective view of a metal plate rebar holder of FIG. 4 and FIG. 5 of the present invention

Referring to FIG. 6, this describes a full dimensional view of FIGS. 4 & 5 and how this component is designed to be used. The horizontal member 36 with it's ⅝ inch hole 40 is placed on a ⅝ inch by 12 inch foundation bolt 25 which is supported by the strong arm components of FIGS. 1 & 2 [see FIG. 9]. The two downward ⅝ inch elongated notches support the top and bottom reinforcing bars 32 see FIG. 6. This bolt and rebar system is accomplished by the three components of FIGS. 1, 2, & 4 [see FIG. 10].

Figure 7:
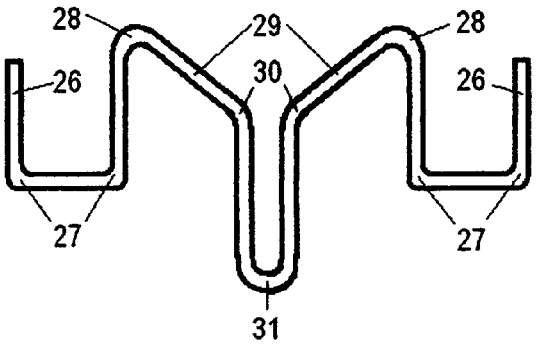
FIG. 7 is a front view of a rebar holder of the present invention used in conjunction with FIG. 8.

Referring to FIG. 7, this is a fifth component of the rebar system designed to be used in footings where no wooden forms can be used to hang the reinforcement bars with the use of the strong arm 18 of FIGS. 2 & 3. It is a 3/16 by 10 inch steel rod bent as described. A ¾ inch vertical arm 26 then bent 90 degrees 27 with a ¾ inch long horizontal arm, then bent 90 degrees upward 27 for a ¾ inch vertical arm, then bent 120 degrees downward 28 for a one and ½ inch arm 29, then again bent downward at 45 degrees 30 for one inch, then 180 degree bend upward 31 for one inch vertically, then again bent upward 45 degrees 30 for one and ½/inches 29 to a 120 degree downward bend 28 for a ¾ inch vertical arm, again bent 90 degrees 27 for ¾ inch horizontal, then bent again upward 90 degrees 27 to a ¾ vertical arm 26.

Figure 8:
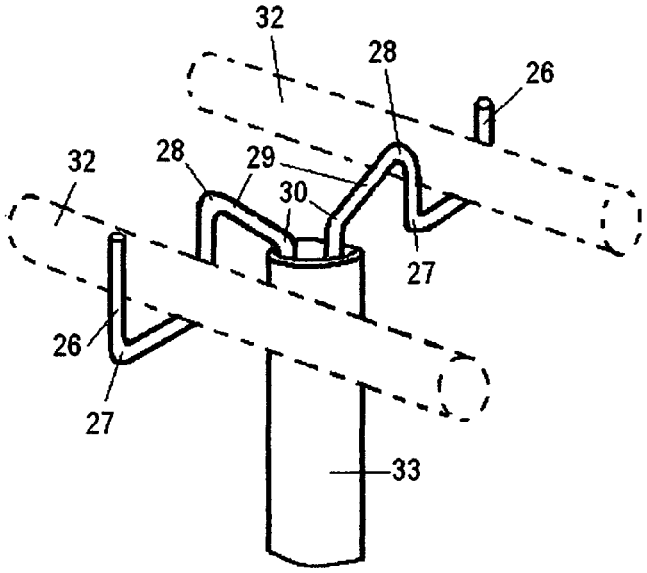
FIG. 8 is a perspective view of the rebar holder of FIG. 7 of the present invention and how it is used.

Referring to FIG. 8, this is a full dimensional view describing the use of a fifth component [FIG. 7]. This describes the devise in use supporting two foundation reinforcing bars 32 with the use of a hollow pipe 33 driven down in the center of a footing. The portion of the devise 31 is placed down into the pipe to support both side arms 29 bent outward from the bends 30 and 30.

Figure 9:
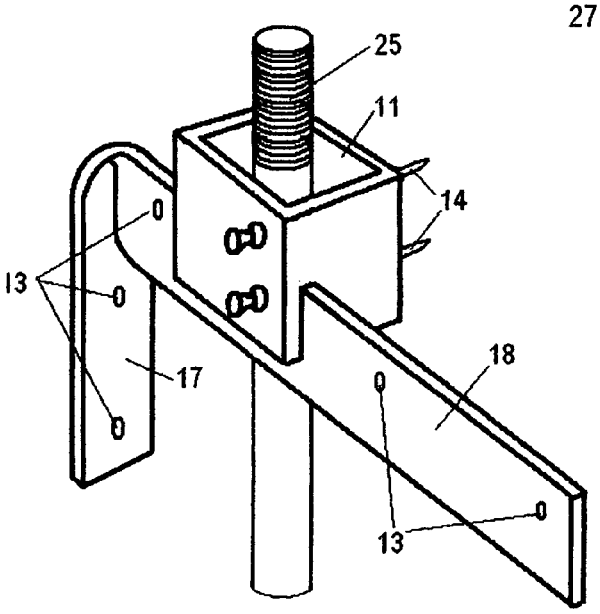
FIG. 9 is a perspective view of a square metal tube bracket and a metal strong arm bracket of FIG. 1 and FIG. 2 of the present invention.
Figure 10:
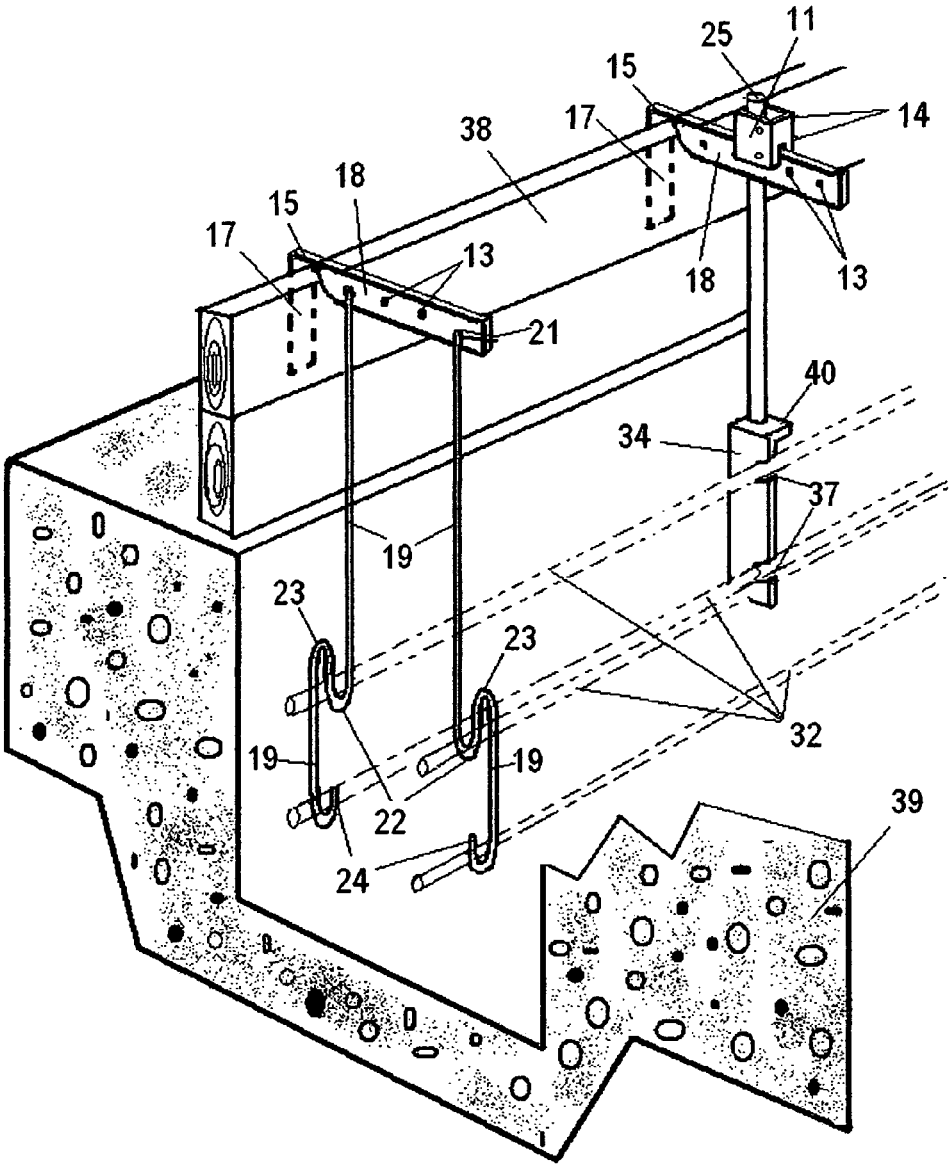
FIG. 10 is a perspective view of an assembled footing form using the multiple components of the present invention.

Referring to FIG. 9, this is a full dimensional view of the first two components A & B used over a typical exterior footing where they can be attached to a wooden form 38 [see FIG. 10].

Referring to FIG. 10, this is a full dimensional view of an exterior footing and all of the components used in conjunction with a wooden form board 38.

I claim:

1. A form assembly comprising a stabilizing apparatus for securing a foundation anchor bolt in a fixed position prior to pouring concrete; the stabilizing apparatus comprising a one inch square metal tube one inch in length with a wall thickness of ⅛ inch, a ⅛ inch wide by ½ inch deep channel cut along at least a first side wall, leaving a ⅝ inch distance from the channel to an end of the first side wall; second and third sidewalls lying perpendicular to the first sidewall each having two ⅛ inch keeper pin holes there through, the holes of each of the second and third side walls lying one above another, with the ⅛ inch wide by ½ inch deep channel fitting into a ⅛ inch wide by a one inch height steel strong arm of a ⅛ inch thick by one inch wide by 11 inch long steel plate; said plate bent at 90 degrees creating a four inch vertical member and a seven inch horizontal arm with the seven inch horizontal arm bent at a 90 degree twist to create said ⅛ inch wide by a one inch height strong arm capable of holding four reinforcing bars with the four inch vertical member having two ⅛ inch nail holes for attaching to a wooden form board and with the seven inch horizontal arm having four ⅛ inch holes to receive keeper pins; and a ⅛ inch by 21 inch long steel rod with bends designed to hook to said strong arm, said rod having two ⅝ inch cradles to hold one upper and one lower foundation reinforcing bars.

* * * * *